US009425533B2

(12) United States Patent
Oosterman et al.

(10) Patent No.: US 9,425,533 B2
(45) Date of Patent: Aug. 23, 2016

(54) ROTATING RECEPTACLE ASSEMBLY

(71) Applicant: Douglas J. Oosterman, Grand Rapids, MI (US)

(72) Inventors: Douglas J. Oosterman, Grand Rapids, MI (US); Gary R. Bacon, Muskegon, MI (US); Andras Kupfermann, Grand Rapids, MI (US)

(73) Assignee: Douglas J. Oosterman, Grand Rapids, MI (US)

( * ) Notice: Subject to any disclaimer, the term of this patent is extended or adjusted under 35 U.S.C. 154(b) by 0 days.

(21) Appl. No.: 14/571,427

(22) Filed: Dec. 16, 2014

(65) Prior Publication Data

US 2015/0380854 A1 Dec. 31, 2015

(30) Foreign Application Priority Data

Jun. 26, 2014 (TW) ..... 103122058 A

(51) Int. Cl.

| | |
|---|---|
| ***H01R 13/44*** | (2006.01) |
| ***H01R 25/00*** | (2006.01) |
| ***H01R 13/70*** | (2006.01) |
| ***H01R 13/66*** | (2006.01) |
| ***H01R 27/02*** | (2006.01) |

(52) U.S. Cl.

CPC ..... *H01R 13/44* (2013.01); *H01R 13/6683* (2013.01); *H01R 13/70* (2013.01); *H01R 25/006* (2013.01); *H01R 27/02* (2013.01)

(58) Field of Classification Search

CPC ..... H01R 13/44; H01R 13/70; H01R 25/006
USPC ..... 439/131, 652, 535
See application file for complete search history.

(56) References Cited

U.S. PATENT DOCUMENTS

| | | | | |
|---|---|---|---|---|
| 4,984,982 | A * | 1/1991 | Brownlie | G02B 6/4451 174/490 |
| 6,897,379 | B1 * | 5/2005 | Hsiao | H01H 9/0214 174/480 |
| 7,621,764 | B2 | 11/2009 | Shunjie | |
| 8,043,116 | B2 * | 10/2011 | Liao | H01R 13/60 439/535 |
| 8,690,590 | B2 * | 4/2014 | Byrne | H05K 5/03 439/131 |
| 9,147,984 | B2 * | 9/2015 | Brookshire | H01R 35/04 |

FOREIGN PATENT DOCUMENTS

| | | | |
|---|---|---|---|
| CN | 201199603 | Y | 2/2009 |

* cited by examiner

*Primary Examiner* — Amy Cohen Johnson
*Assistant Examiner* — Milagros Jeancharles
(74) *Attorney, Agent, or Firm* — Alan D. Kamrath; Kamrath IP Lawfirm, P.A.

(57) ABSTRACT

A rotatable socket assembly, provided in form of a rotatable socket, includes: a side provided with a socket unit and a functional socket, and an adjacent side provided with a flat surface. The rotatable socket starts rotating, when a switch on an active surface of the rotatable socket is pressed to start the driving motor, such that check elements connected to the active end of the driving motor drive the rotatable socket to rotate by a predetermined angle to cause the socket to face upward, thereby facilitating the use of a plug. Alternatively, when the plug is not in use, the switch at a predetermined angle is pressed, such that the check elements connected to the active end of the driving motor drive the rotatable socket to rotate by a predetermined angle to cause the flat surface to face upward and enable the socket to face laterally and get hidden.

9 Claims, 10 Drawing Sheets

ROTATING RECEPTACLE ASSEMBLY

BACKGROUND OF THE INVENTION

1. Technical Field

The present invention relates to rotatable socket assemblies and, more particularly, to provide a power socket for admitting a plug of various electrical appliances or 3C products. The power socket is easy to manufacture and thus cuts the total socket cost. The power socket in operation is easy to turn over and thereby effectuate a predefined state of use of the plug and turn over again to come to a flat hidden state.

2. Description of Related Art

A conventional power socket for use with a plug at one end of a power cord of various electrical appliances or 3C products usually has a plurality of slots for admitting positive and negative pins of the plug. A control switch is disposed beside the slots and adapted to switch between ON/OFF states to not only allow the power to be turned off without unplugging the plug but also to provide overload-proof protection. Furthermore, it is convenient that a plug at one end of a power cord of conventional 3C products comes in the form of a USB terminal. To this end, the industrial sector developed a power socket with a USB slot for admitting the USB terminal. However, the aforesaid two power sockets in operation are usually restricted to a single function. That is, users have to choose between the conventional power socket and a socket with a USB slot or use both as needed. In addition, when not in use, the conventional power socket always has its slot facing outward, and thus ambient dust is likely to adhere to the surface of the socket and intrude into the slot, or the slot is likely to be wetted by a spill inadvertently.

To overcome the aforesaid drawbacks of the prior art, CN201113093Y, entitled Multi-functional Socket, issued on Sep. 10, 2008 is directed to a socket assembly characterized in that a power socket, a network socket, and a phone line socket are concurrently coupled and disposed beside an insertion rack in the socket. Each socket in operation can turn over to face upward, and each socket not in operation can rotate by 180 degrees to be hidden in the insertion rack of the socket. Hence, ambient droplets and foreign bodies cannot invade into the sockets, and, when not in use, each slot is hidden to assume a flat attractive appearance. CN201199603Y, entitled Socket Device Hidden when Rotated, issued on Feb. 25, 2009, is directed to a socket assembly which is based on the rotatable socket of CN201113093Y and characterized in that an output shaft at one end of a power motor and a socket casing are disconnectably connected by a clutch. A socket is manually rotated whenever the motor fails or needs to manually change state. Both flip change and clutch rotation are controllably applicable to socket function, illumination function, and hiding function embodied in the socket assembly.

To improve the aforesaid prior art, the present invention provides a power socket for admitting a plug of various electrical appliances or 3C products. The power socket is easy to manufacture and thus cuts the total socket cost. The power socket in operation is easy to turn over and thereby effectuate a predefined state of use of the plug and turn over again to come to a flat hidden state.

SUMMARY OF THE INVENTION

The present invention provides a rotatable socket for admitting a plug of various electrical appliances or 3C products. The rotatable socket is easy to manufacture, is compact, and cuts cost. The rotatable socket is characterized in that the rotatable socket has one side which predefines a socket unit and a functional socket. The rotatable socket has an adjacent side which predefines a flat surface. To rotate the rotatable socket, a user presses a switch disposed on an active surface to turn on a driving motor, such that a check element connected to an active end of the driving motor drives the rotatable socket to rotate by a predetermined angle to enable the socket to face upward and thus facilitate the use of the plug. When the rotatable socket is not in use, the user presses the switch to cause the driving motor to drive, through the check element connected to the active end of the driving motor, the rotatable socket to rotate by a predetermined angle to enable the flat surface to face upward and enable the socket to face laterally and get hidden.

The first objective of the present invention is to provide a rotatable socket which comprises a socket body, a driving motor, front and rear check elements, an abutting element, front and rear cover elements, and front and rear clamping elements. The socket body has one side provided with one or more socket units and one or more functional sockets and has an adjacent side provided with a flat surface. The driving motor is disposed in the socket body. The outward end of the driving motor is coupled to the front check element. The abutting element is disposed inward relative to the front check element and laterally imposes a positional restriction on the socket body. The other side of the socket body is coupled to the rear check element. One end of a shaft of the driving motor is inserted into an intermediate bushing of the front cover element coupled to one end of each border frame mounted at the outer periphery of the socket body. A rear cover element is coupled to the other side of each border frame at the outer periphery of the socket body. The outward side of the front cover element into which one end of the shaft of the driving motor is inserted is coupled to the clamping elements in an appropriately tight manner. The driving motor rotates to drive the socket of the rotatable socket to flip and face upward, so that the socket unit or functional socket is accessible. When not in use, the driving motor drives the flat surface of the rotatable socket to flip and face upward and cause the socket to face laterally and get hidden.

The second objective of the present invention is that both the abutting element and the front check element coupled laterally to the socket body are fitted to the active end of the driving motor at the periphery of intermediate holes. The inward end of the abutting element extends to form one or more branch portions inserted into a space disposed at a corresponding position of the socket body. The adjacent periphery of the branch portion of the abutting element extends to form a restrictive flange which is inserted into the internal periphery of the socket body to effectuate a positional restriction. After after the front check element and the active end of the driving motor have been coupled together by a screwing element, the front check element is fastened to the space at a corresponding periphery of the socket body by a screwing element, such that the active end of the driving motor in operation drives the socket body to rotate.

The third objective of the present invention is that the rear check element coupled to the other side of the socket body is fastened to a space at a corresponding periphery of the socket body by a screwing element, and an outward side of the rear check element extends to form a flange insertable into a recess corresponding in position to the rear cover element. The front check element, which is fixed in place by the socket body coupled to one end of the driving motor, also extends outward to form a flange insertable into another recess corresponding in position to the front cover element, such that the socket body is movably mounted between the front and rear cover elements to rotate by a predetermined angle.

The fourth objective of the present invention is that the clamping elements are coupled to outward sides of the front and rear cover elements of each border frame at the outer periphery of the socket body. Two outer peripheries of the front and rear cover elements dent to form guide grooves and, together with two notches facing downward, allow corresponding portions of the clamping elements to extend and form protruding portions moving upward from the notches, undergoing vertical displacement with a touch of appropriate tightness along the peripheries of the front and rear cover elements. Upward portions of the clamping elements form one or more spaced-apart resilient abutting portions which suit the thickness of an object mounted in advance to effectuate resilient clamping within a predetermined range.

The fifth objective of the present invention is that a sensor is disposed outside of the socket unit and the functional socket coupled laterally to the socket body. When the socket unit and the functional socket on the side of the socket body are in use or touched by a human hand, light of the sensors on both sides is blocked to therefore prevent a control unit of the driving motor from operating, thereby effectuating a security mechanism.

The sixth objective of the present invention is that switches capable of toggling back and forth are disposed on upward surfaces of the rear cover element disposed at a rear portion of each border frame at an outer periphery of the socket body to controllably start the driving motor coupled to the socket body, and the front check element drives the socket body to flip by a predetermined angle.

The seventh objective of the present invention is that the driving motor coupled to the socket body is capable of performing a range of motion of 90 degrees, forward and reverse.

The eighth objective of the present invention is that a limiting element is disposed at the outward end at a predetermined portion of the front check element disposed at the periphery of the driving motor coupled to the socket body, such that the limiting element is subjected to an appropriate motion range restraint imposed by a space inside the front cover element as soon as the socket body has rotated by a predetermined angle.

The ninth objective of the present invention is that a soft, yet tough, concealing element is coupled to the inward sides of two border frames positioned at a high level and between the front and rear cover elements and each border frame mounted at the outer periphery of the socket body, such that all the upward-facing sides of the socket body are flat and hidden.

DETAILED DESCRIPTION OF THE EMBODIMENTS OF THE INVENTION

Figure 1:
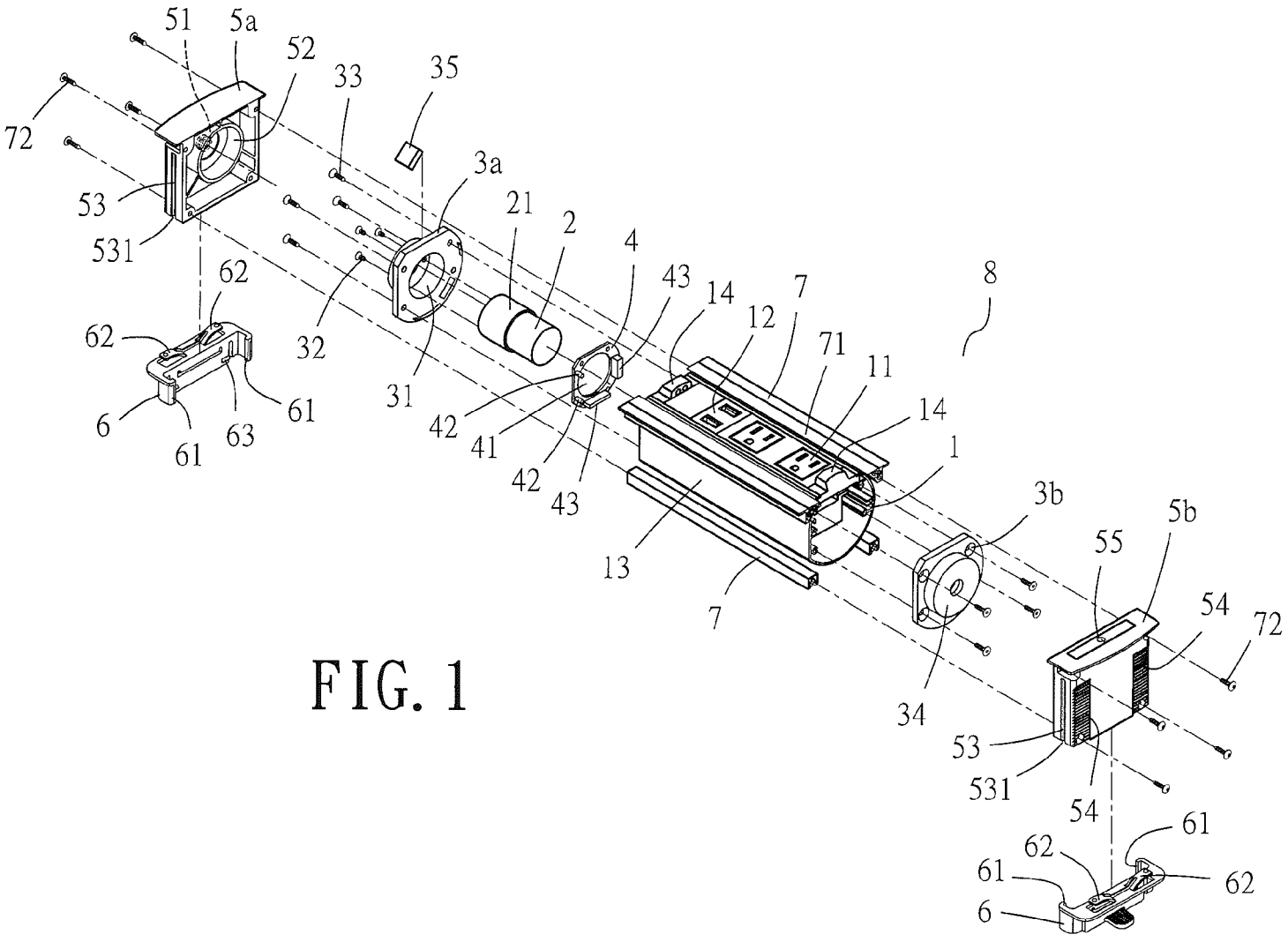
FIG. 1 is an exploded view of a rotatable socket of the present invention.
Figure 2:
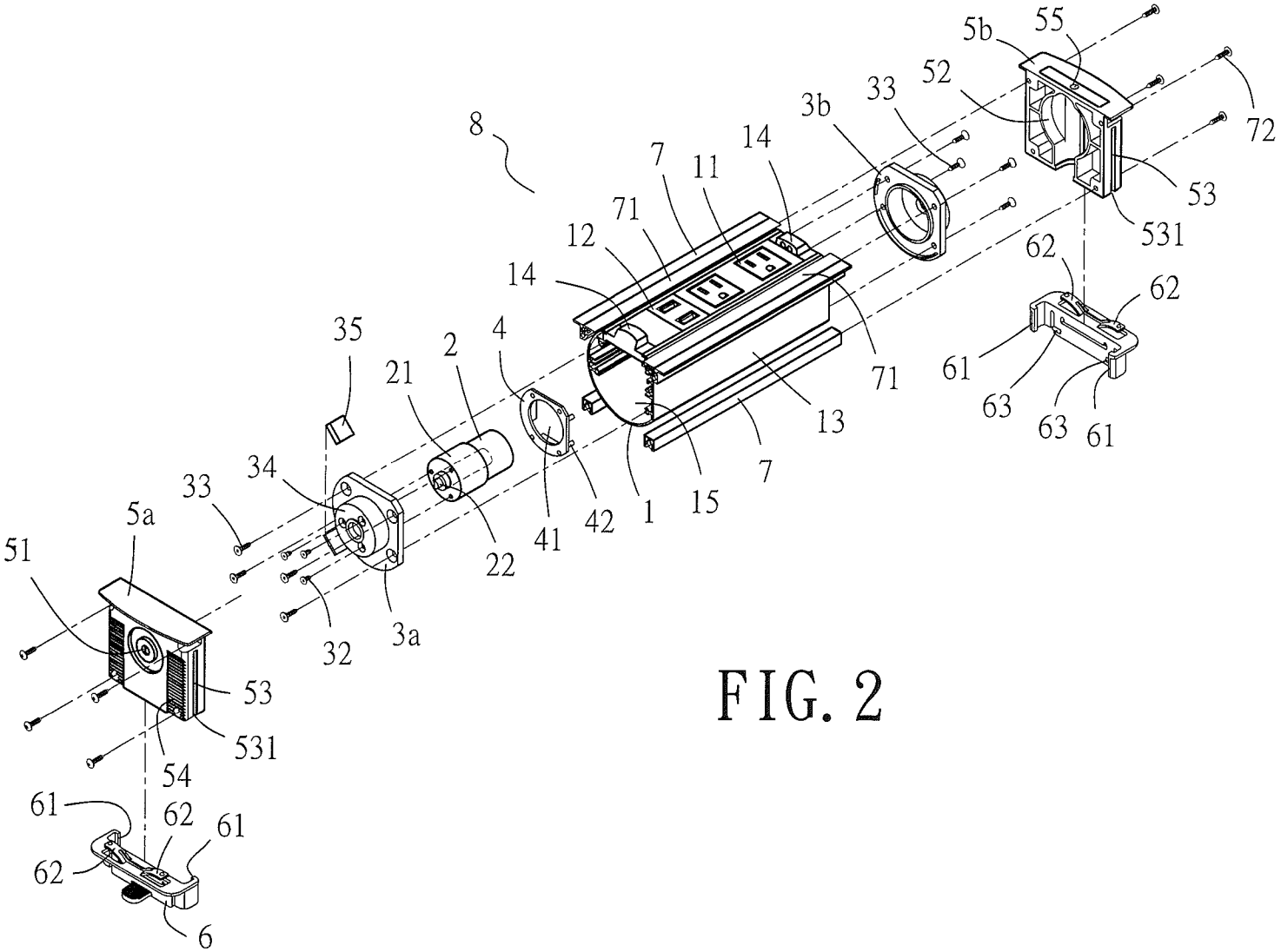
FIG. 2 is an exploded view of the rotatable socket viewed from another angle according to the present invention.

A rotatable socket assembly (shown in FIG. 1, FIG. 2) of the present invention is provided in the form of a rotatable socket 8 which comprises a socket body 1, a driving motor 2, a front check element 3*a*, a rear check element 3*b*, an abutting element 4, a front cover element 5*a*, a rear Cover element 5*b*, and front and rear clamping elements 6.

One or more socket units 11 and one or more functional sockets 12 are disposed on one side of the socket body 1. A flat surface 13 is disposed on an adjacent side of the socket body 1. A sensor 14 is disposed outside of the socket unit 11 and the functional socket 12 of the socket body 1. The driving motor 2 is disposed inside the socket body 1, and its outward end is coupled to the front check element 3*a* (shown in FIG. 1, FIG. 2, FIG. 7). The abutting element 4 is disposed inward relative to the front check element 3*a* and laterally imposes a positional restriction on the socket body 1. Both the abutting element 4 and the front check element 3*a* coupled laterally to the socket body 1 are fitted to the active end of the driving motor 2 at the periphery of intermediate holes 31, 41. The inward end of the abutting element 4 extends to form one or more branch portion 42 which is inserted into a space 15 disposed at a corresponding position of the socket body 1. The adjacent periphery of the branch portion 42 of the abutting element 4 extends to form a restrictive flange 43 which is inserted into the internal periphery of the socket body 1 to effectuate a positional restriction. The front check element 3*a* and the active end 21 (which comes in the form of a casing) of the driving motor 2 are coupled together by a screwing element 32. Then, the front check element 3*a* is fastened to the space 15 at a corresponding periphery of the socket body 1 by a screwing element 33, such that the active end of the driving motor 2 in operation drives the socket body 1 to rotate. The other side of the socket body 1 is coupled to the rear check element 3*b* by the screwing element 33.

As mentioned before, one end of a shaft 22 of the driving motor 2 is inserted into an intermediate bushing 51 of the front cover element 5*a* coupled to one end of each border frame 7 mounted at the outer periphery of the socket body 1, whereas the other side of each border frame 7 at the outer periphery of the socket body 1 is coupled to the rear cover element 5*b* by a screwing element 72. The outward side of the rear check element 3*b* coupled to the other side of the socket body 1 extends to form a flange 34 which can be inserted into a recess 52 corresponding in position to the rear cover element 5*b*. The front check element 3*a*, which is fixed in place by the socket body 1 coupled to one end of the driving motor 2, also extends outward to form a flange 34 which can be inserted into another recess 52 corresponding in position to the front cover element 5*a*. Hence, the socket body 1 is movably mounted between the front and rear cover elements 5*a*, 5*b* to rotate by a predetermined angle. A soft yet tough concealing element 71 is coupled to the inward sides of two border frames 7 positioned at a high level and between the front and rear cover elements 5*a*, 5*b* and each border frame 7 mounted at the outer periphery of the socket body 1. Hence, all the upward-facing sides of the socket body 1 are flat and hidden.

Figure 3:
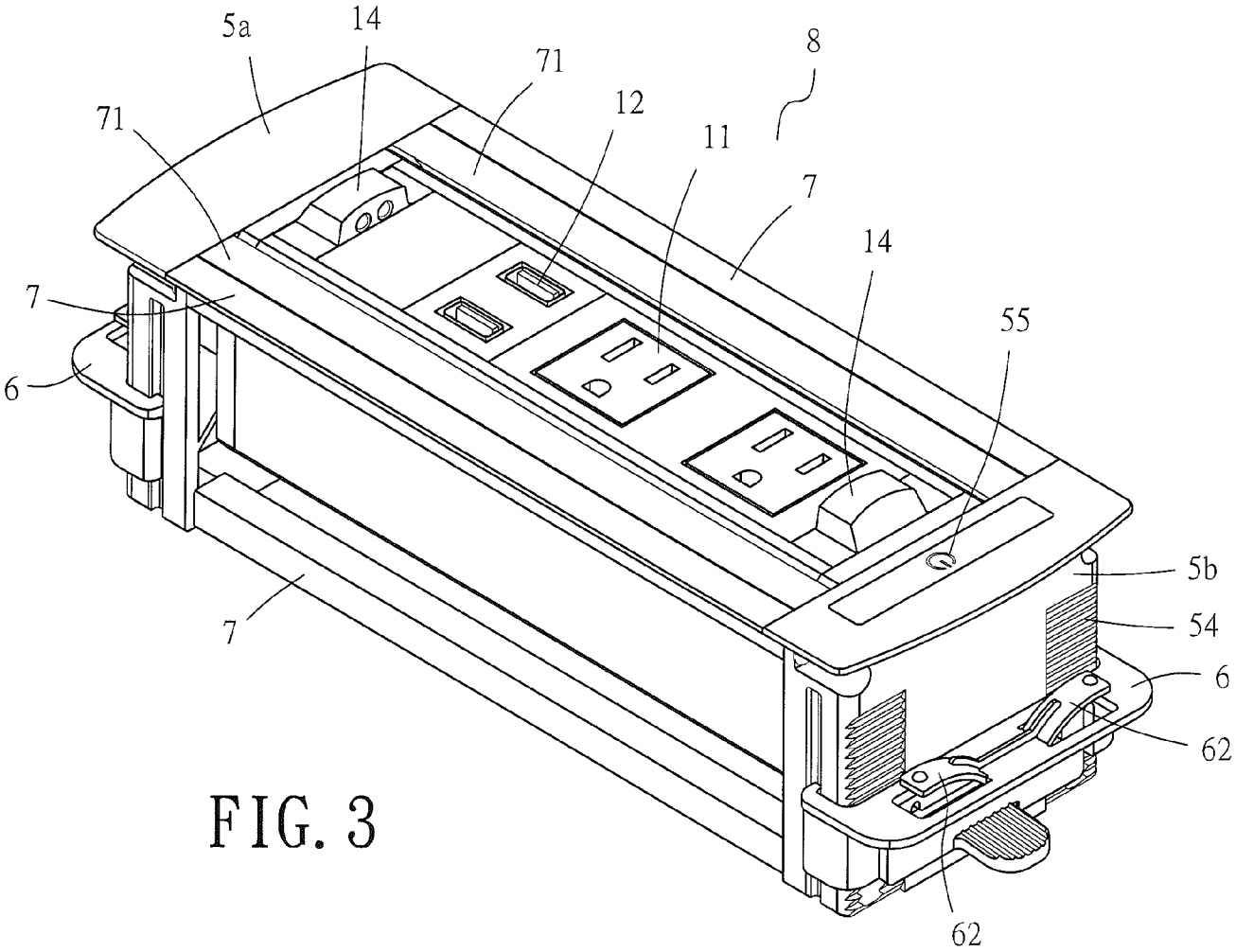
FIG. 3 is a perspective view of the rotatable socket according to the present invention.
Figure 4:
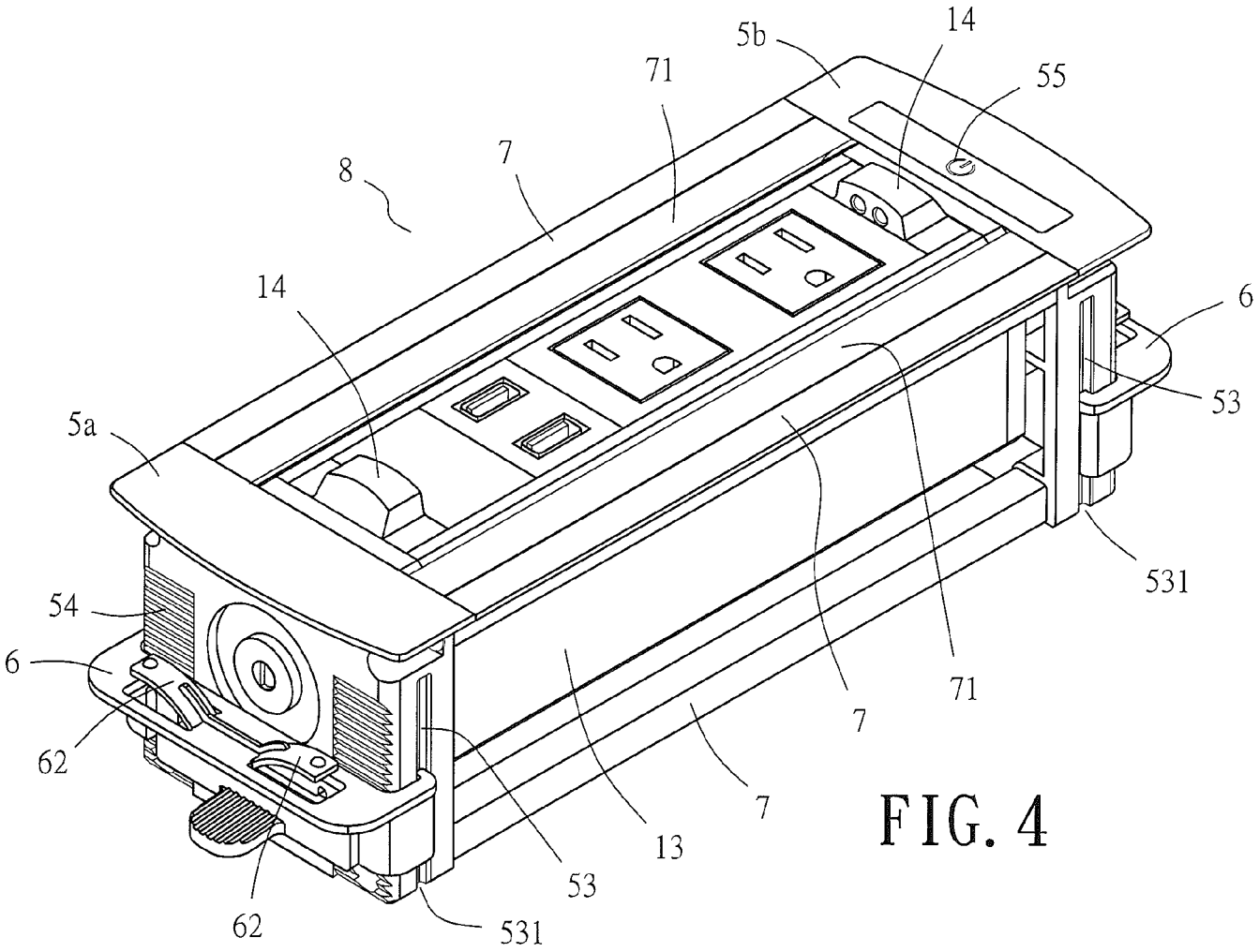
FIG. 4 is a perspective view of the rotatable socket viewed from another angle according to the present invention.

The clamping elements 6 are coupled, in an appropriately tight manner, to the outward sides of the front cover element 5*a* and the rear cover element 5*b* into which one end of the shaft 22 of the driving motor 2 is inserted. The clamping elements 6 (shown in FIG. 3, FIG. 4) can be coupled to the outward sides of the front and rear cover elements 5*a*, 5*b* of each border frame 7 at the outer periphery of the socket body 1. Two outer peripheries of the front and rear cover elements 5*a*, 5*b* dent to form guide grooves 53 and, together with two notches 531 facing downward, allow corresponding portions of the clamping elements 6 to extend and form protruding portions 61 moving upward from the notches 531, undergoing vertical displacement with a touch of appropriate tightness along the peripheries of the front and rear cover elements 5*a*, 5*b*. Upward portions of the clamping elements 6 form one or more spaced-apart resilient abutting portions 62 which suit the thickness of an object (such as a desktop) mounted in advance to effectuate resilient clamping within a predetermined range. Predetermined segments on the outward sides of the front and rear cover elements 5*a*, 5*b* form a plurality of serrate surfaces 54 which extend continuous and horizontally to therefore effectuate an appropriate skid prevention when in contact with a positioning block 63 of the clamping elements 6.

Figure 7:
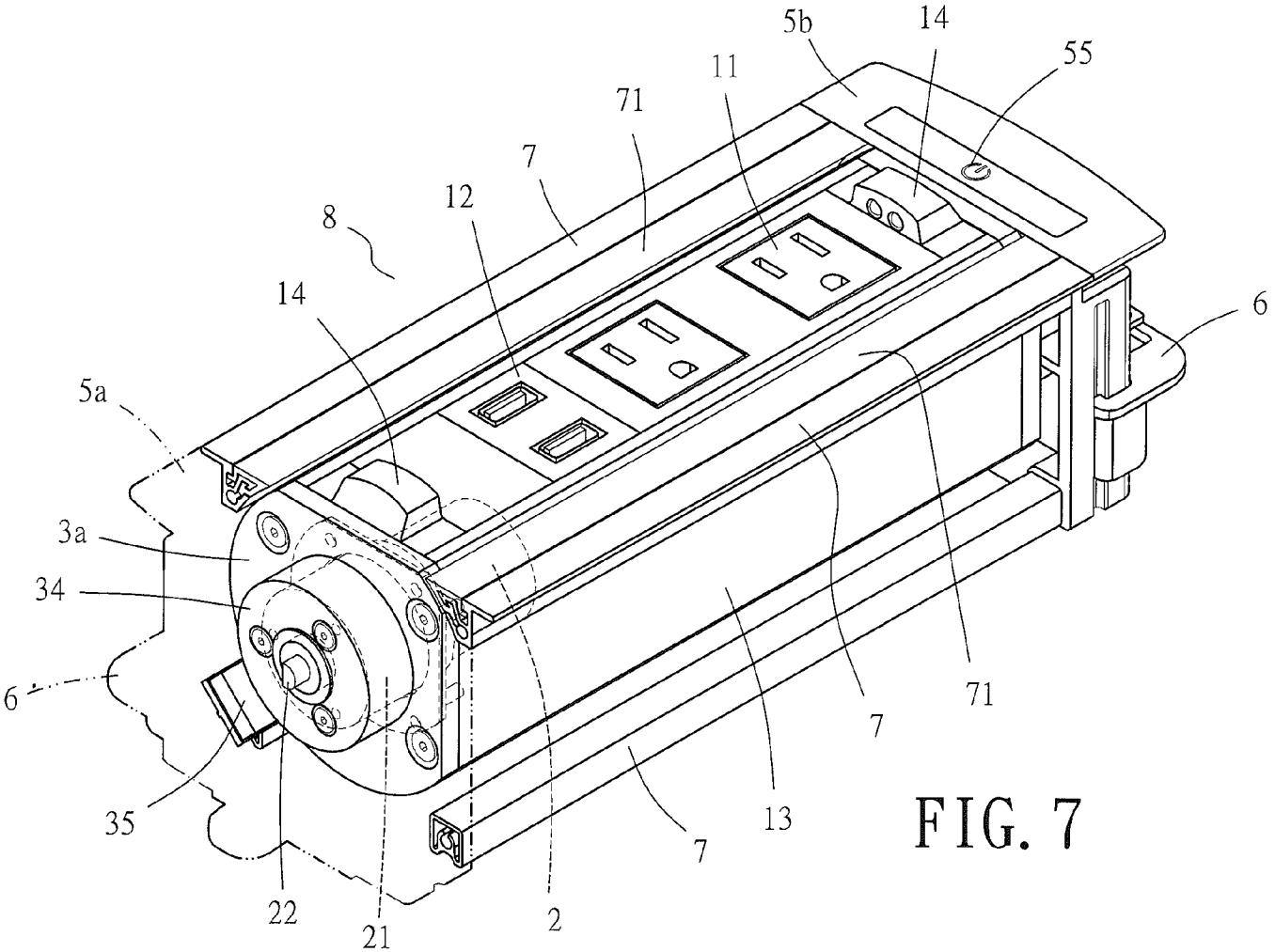
FIG. 7 is a schematic perspective view of the rotatable socket before being rotated according to the present invention.
Figure 10:
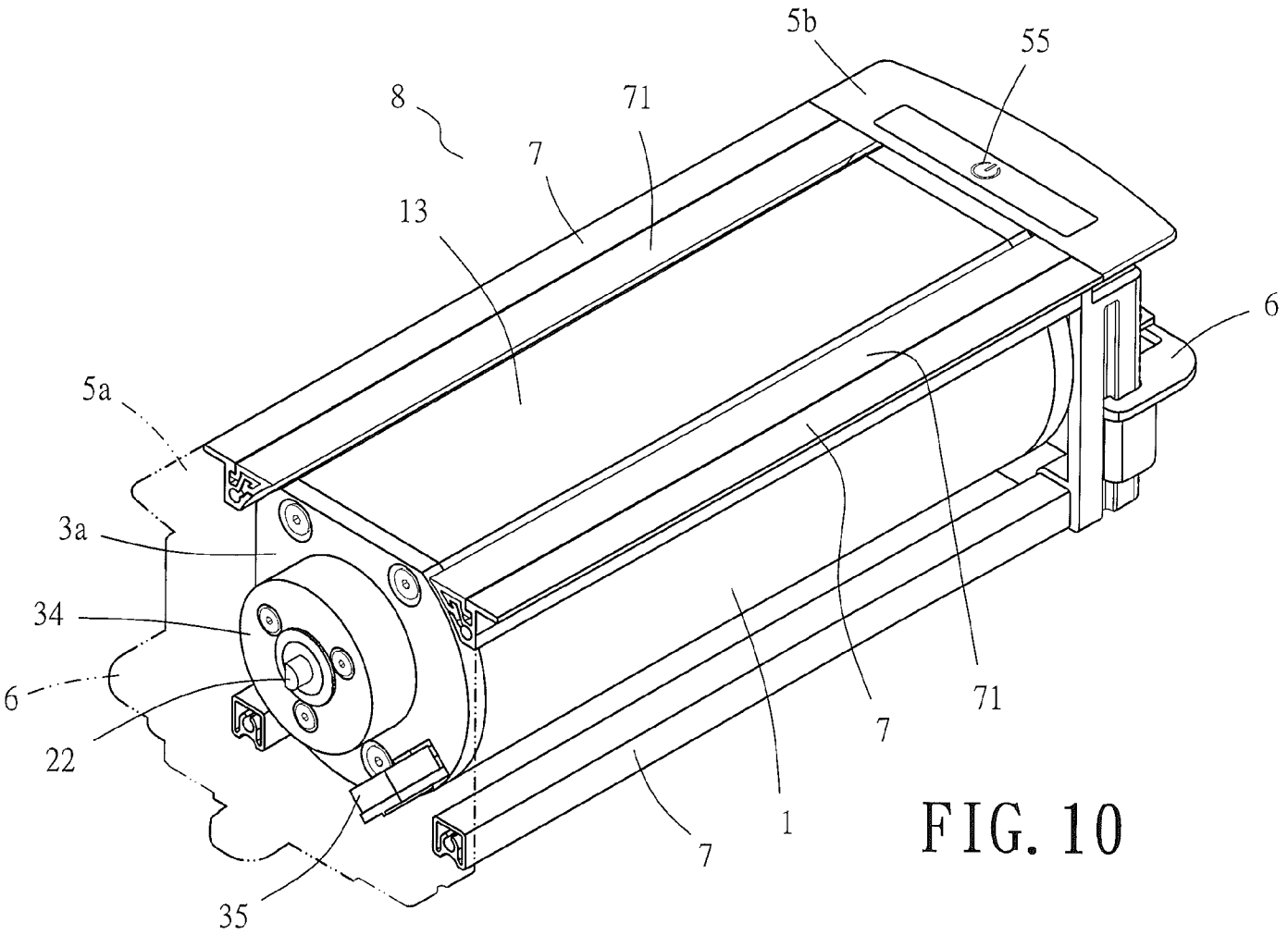
FIG. 10 is a schematic perspective view of the rotatable socket rotated by 90 degrees according to the present invention.

One or more switches 55 (shown in FIG. 3, FIG. 4) capable of toggling back and forth are disposed on upward surfaces of the rear cover element 5*b* of each border frame 7 at the outer periphery of the socket body 1 to controllably start the driving motor 2 coupled to the socket body 1, and the front check element 3*a* drives the socket body 1 to flip by a predetermined angle (shown in FIG. 7, FIG. 10). A limiting element 35 (shown in FIG. 1, FIG. 2, FIG. 7) is disposed at the outward end at a predetermined portion of the front check element 3*a* disposed at the periphery of the driving motor 2 coupled to the socket body 1, such that the limiting element 35 is subjected to an appropriate motion range restraint imposed by a space 56 inside the front cover element 5*a* as soon as the socket body 1 has rotated by a predetermined angle. In this regard, the driving motor 2 coupled to the socket body 1 is capable of performing a range of motion of 90 degrees, forward and reverse, to form the rotatable socket 8.

The functional socket 12 coupled to the socket body 1 laterally comes in the form of a slot selected from the group consisting of one or more HDMI (high-definition multimedia interface), USB, Ethernet (Internet data), VGA (video), RCA (video), RCA (audio), and 3.5 mm plug (audio) to admit a plug of 3C products to effectuate electrical conduction. The socket unit 11 disposed laterally at the socket body 1 is configured to operate under different voltages including 110V and 220V.

Figure 5:
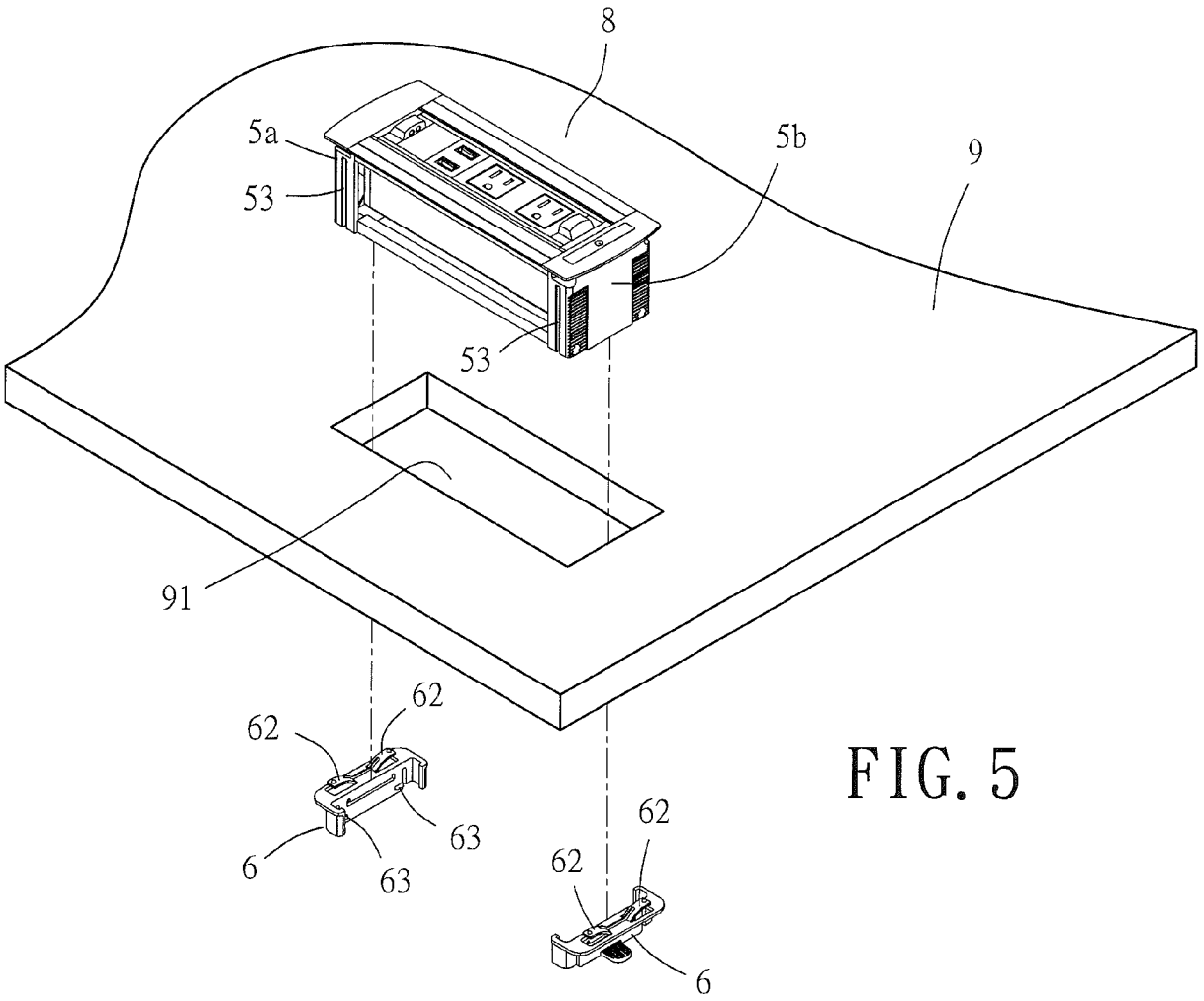
FIG. 5 is a schematic view of a desktop and the rotatable socket, not put together, according to the present invention.
Figure 6:
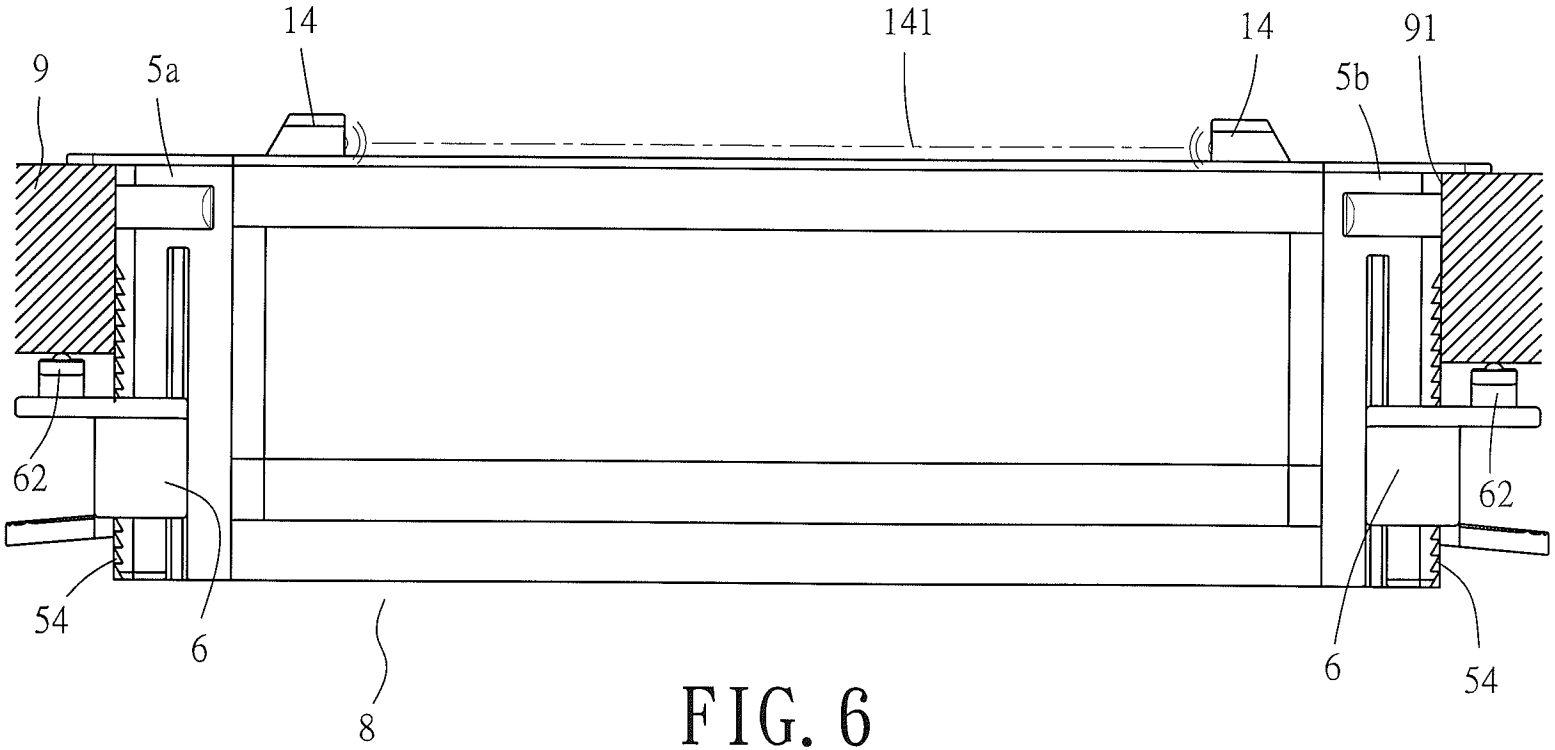
FIG. 6 is a schematic front view of the desktop and the rotatable socket, put together, according to the present invention.

To enable the rotatable socket 8 to operate in conjunction with a predetermined object (such as a desktop 9) (shown in FIG. 5), it is feasible to remove the clamping elements 6 disposed on the outward side of the front and rear cover elements 5*a*, 5*b*, such that the rotatable socket 8 is inserted and moved downward in accordance with a predefined hole 91 of the desktop 9. Afterward, the removed clamping elements 6 are inserted and moved along the two outer guide grooves 53 of the front and rear cover elements 5*a*, 5*b* and then moved upward. Hence, the two resilient abutting portions 62 disposed above the clamping elements 6 abut against the bottom (shown in FIG. 6) of a mounted object (such as the desktop 9) with appropriate tightness.

Figure 8:
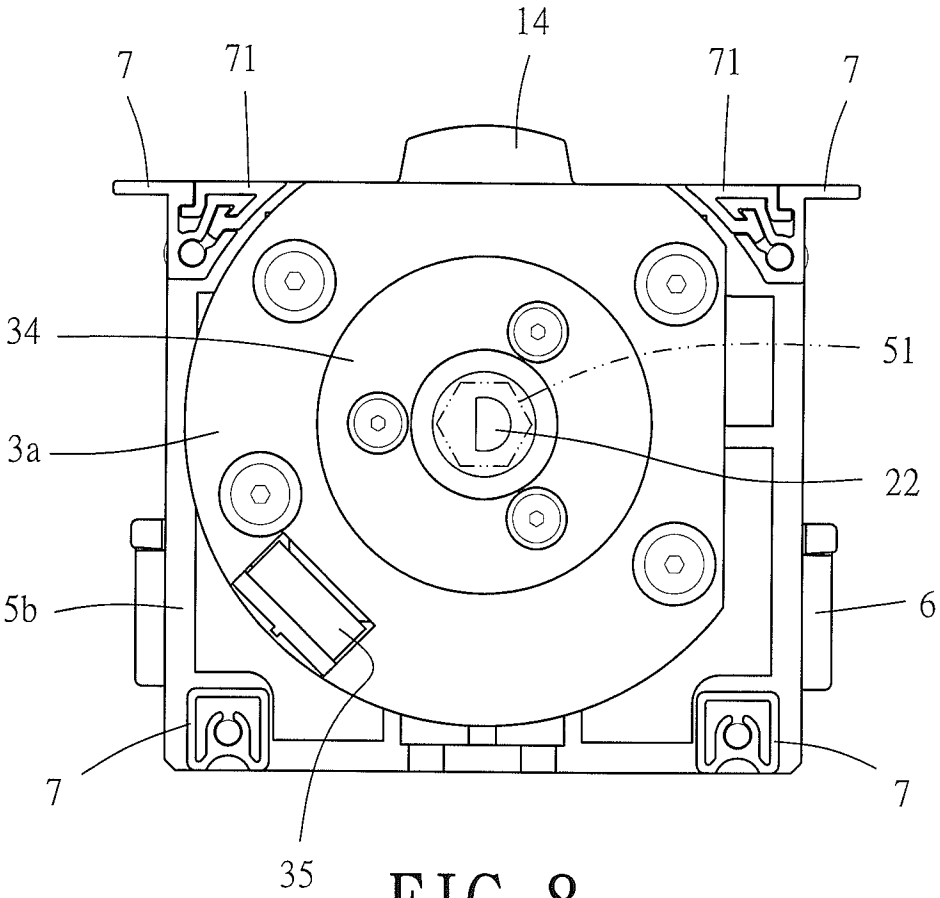
FIG. 8 is a schematic side view of the rotatable socket before being rotated according to the present invention.

To start operating the rotatable socket 8 (shown in FIG. 6) disposed at a predetermined object (such as the desktop 9), it is practicable to press a switch 55 (shown in FIG. 7) capable of toggling back and forth and disposed on an upward surface of the rear cover element 5*b* to controllably start the driving motor 2 coupled to the socket body 1, and the active end 21 of the driving motor 2 drives the front check element 3*a* to drive the socket body 1 to flip by a predetermined angle. Hence, when the socket unit 11 or functional socket 12 is in use, the driving motor 2 rotates to drive the socket of the rotatable socket 8 to turn and thus face upward. When the socket unit 11 and the functional socket 12 disposed on the side of the socket body 1 are in use or touched by a human hand, the light 141 of the sensor 14 on the two sides is blocked (shown in FIG. 6, FIG. 8), thereby preventing a control unit of the driving motor 2 from operating and effectuating a security mechanism.

Figure 9:
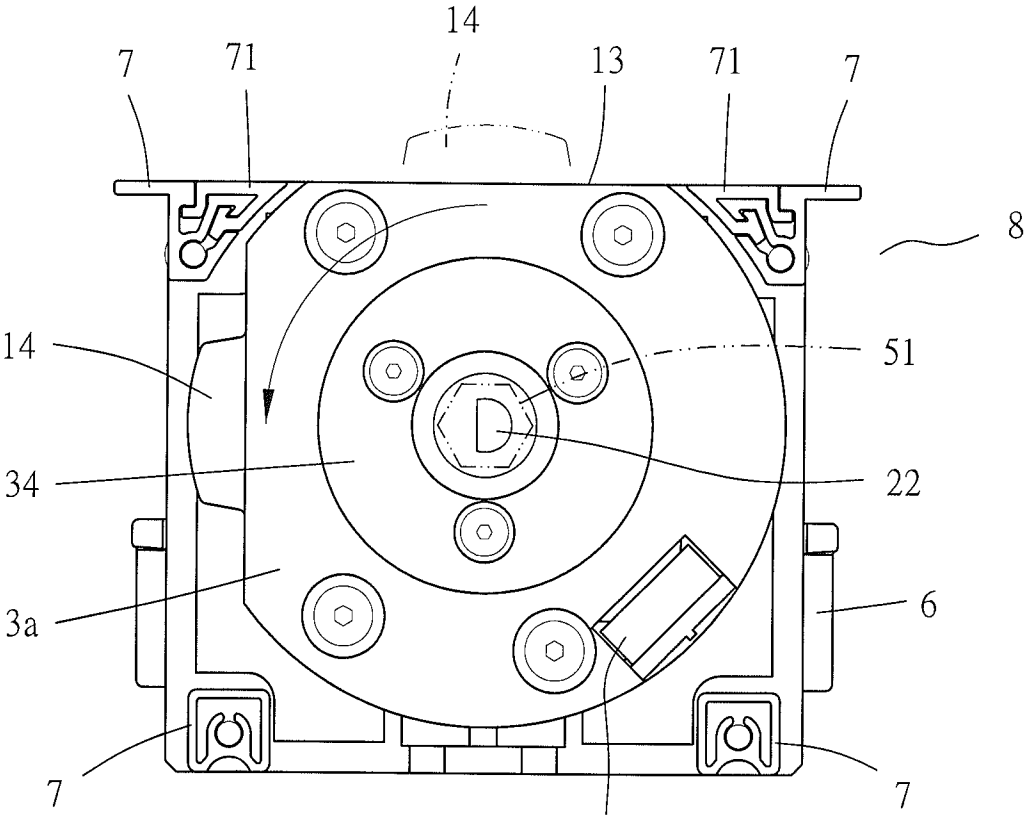
FIG. 9 is a schematic side view of the rotatable socket rotated by 90 degrees according to the present invention.

When the rotatable socket 8 is not in use and the user wants to rotate the socket sideward (shown in FIG. 8, FIG. 9), the user presses switches 55 (shown in FIG. 7) capable of toggling back and forth and disposed on upward surfaces of the rear cover element 5*b* to controllably start the driving motor 2 coupled to the socket body 1. An active end 21 of the driving motor 2 drives the front check element 3*a* to drive the socket body 1, to drive the flat surface 13 of the rotatable socket 8 to flip and thus face upward and enable the socket body 1 to face laterally and get hidden (shown in FIG. 9, FIG. 10).

The advantages of the rotatable socket in operation are as follows:

1. Flip as needed to enable the socket to face upward or get hidden.
2. The rotatable socket suits an object mounted beforehand to effectuate simple and precise positional clamping.
3. The rotatable socket is capable of flipping rapidly forward and reversely within a predefined range of 90 degrees to enable the socket body to face upward for usage or face laterally and get hidden.
4. The rotatable socket is delicate and convenient to be put together with pre-mounted object properly.
5. The USB slot formed at the functional socket coupled laterally to the rotatable socket is configured to operate with power options (including the power options of 1000 mA, and 2000 mA or other power options.)

What is claimed is:

1. A rotatable socket assembly comprising: a socket body, a driving motor, front and rear check elements, an abutting element, front and rear cover elements, and front and rear clamping elements, wherein the socket body has an outer periphery including border frames, a side provided with one or more socket unit and one or more functional socket and an adjacent side provided with a flat surface, wherein the driving motor is disposed in the socket body, wherein an outward end of the driving motor is coupled to the front check element, wherein the abutting element is disposed inward relative to the front check element and laterally imposes a positional restriction on the socket body, wherein another side of the socket body is coupled to the rear check element, wherein an end of a shaft of the driving motor is inserted into an intermediate bushing of the front cover element coupled to an end of each border frame of the outer periphery of the socket body, wherein the rear cover element is coupled to another end of each border frame of the outer periphery of the socket body, wherein an outward side of the front cover element into which one end of the shaft of the driving motor is inserted and the rear cover element are coupled to the front and rear clamping elements in an appropriately tight manner, wherein the front and rear clamping elements are coupled to outward sides of the front and rear cover elements of each border frame of the outer periphery of the socket body, wherein two outer peripheries of the front and rear cover elements dent to form first and second guide grooves each terminating in a notch facing downward, wherein first and second protruding portions extend from each clamping element and move upward in the first and second guide grooves from the notches to provide resistance along the two outer peripheries of the front and rear cover elements, wherein upward portions of each of the front and rear clamping elements form one or more spaced-apart resilient abutting portions which suit a thickness of an object mounted in advance to effectuate resilient clamping within a predetermined range, wherein the driving motor rotates to drive the socket to flip and face upward so that the socket unit or functional socket is accessible, and wherein when not in use, the driving motor drives the flat surface of the rotatable socket to flip and face upward and cause the socket body to face laterally and get hidden.

2. The rotatable socket assembly of claim 1, wherein the rear check element coupled to another side of the socket body is fastened to a corresponding periphery of the socket body by a screwing element, wherein an outward side of the rear check element extends to form a flange insertable into a recess corresponding in position to the rear cover element, wherein the front check element, which is fixed in place by the socket body coupled to one end of the driving motor, also extends outward to form a flange insertable into another recess corresponding in position to the front cover element, and wherein the socket body is movably mounted between the front and rear cover elements to rotate by a predetermined angle.

3. The rotatable socket assembly of claim 1, wherein a sensor is disposed outside of the socket unit and the functional socket coupled laterally to the socket body, wherein when the socket unit and the functional socket of the socket body are in use or touched by a human hand, light of the sensors on both sides is blocked to therefore prevent a control unit of the driving motor from operating, thereby effectuating a security mechanism.

4. The rotatable socket assembly of claim 1, wherein one or more switches capable of toggling back and forth are disposed on upward surfaces of the rear cover element disposed at a rear portion of each border frame at an outer periphery of the socket body to controllably start the driving motor coupled to the socket body, and the front check element drives the socket body to flip by a predetermined angle.

5. The rotatable socket assembly of claim 1, wherein the driving motor coupled to the socket body rotates the socket body to a lateral position, forward and reverse.

6. The rotatable socket assembly of claim 1, wherein a concealing element is coupled to inward sides of two border frames positioned between the front and rear cover elements and each border frame of the outer periphery of the socket body.

7. The rotatable socket assembly of claim 1, wherein each functional socket of the socket body is in a form of a slot selected from the group consisting of one or more HDMI (high-definition multimedia interface), USB, Ethernet (Internet data), VGA (video), RCA (video), RCA (audio), and 3.5 mm plug (audio) to admit a plug of 3C products to effectuate electrical conduction.

8. The rotatable socket assembly of claim 7, wherein one or more USB slot formed of the functional socket is coupled laterally to the socket body to operate with power options.

9. The rotatable socket assembly of claim 1, wherein each socket unit is disposed laterally at the socket body to operate under different voltages including 110V and 220V.

* * * * *